US007438355B2

(12) United States Patent
Pedemonte

(10) Patent No.: US 7,438,355 B2
(45) Date of Patent: Oct. 21, 2008

(54) MULTI-FUNCTION TRANSPORTABLE RECREATION CHAIR

(76) Inventor: G. Daniel Pedemonte, 1550 N. Lake Shore Dr., Apt. 32E, Chicago, IL (US) 60610

( * ) Notice: Subject to any disclaimer, the term of this patent is extended or adjusted under 35 U.S.C. 154(b) by 0 days.

(21) Appl. No.: 11/240,743

(22) Filed: Sep. 30, 2005

(65) Prior Publication Data

US 2006/0071513 A1 Apr. 6, 2006

Related U.S. Application Data

(60) Provisional application No. 60/615,071, filed on Oct. 1, 2004.

(51) Int. Cl.
*A47C 4/00* (2006.01)
*A47C 7/62* (2006.01)

(52) U.S. Cl. ..... 297/17; 297/188.04; 297/188.13; 297/188.14; 297/217.4

(58) Field of Classification Search ..... 297/188.14, 297/188.19, 16.2, 51, 217.4, 183.5, 183.4, 297/188.04, 188.01, 30, 188.21, 354.13, 297/17, 227, 411.34, 188.13, 188.08, 188.09; 16/365, 385, 239; 190/8
See application file for complete search history.

(56) References Cited

U.S. PATENT DOCUMENTS

| | | | | | |
|---|---|---|---|---|---|
| 811,475 | A * | 1/1906 | Bradley | 190/8 |
| 1,673,988 | A * | 6/1928 | Giacomo | 190/8 |
| 1,762,580 | A * | 6/1930 | Menk | 190/8 |
| 3,179,465 | A * | 4/1965 | Roberts | 297/17 |
| 3,881,221 | A * | 5/1975 | Schmidt | 16/366 |
| 4,684,278 | A * | 8/1987 | Rauschenberger | 403/84 |
| 4,730,869 | A * | 3/1988 | Schumacher | 297/188.18 |
| 5,139,308 | A * | 8/1992 | Ziman | 297/188.06 |
| 5,350,215 | A | 9/1994 | Demars | |
| 5,409,291 | A | 4/1995 | Lamb | |
| 5,700,053 | A * | 12/1997 | Downing | 297/227 |
| 5,715,573 | A * | 2/1998 | Holemans | 16/287 |
| 6,036,262 | A | 3/2000 | Shahid | |
| 6,402,231 | B1 * | 6/2002 | Pedemonte | 297/17 |
| 6,523,894 | B1 | 2/2003 | Mellace | |

FOREIGN PATENT DOCUMENTS

| | | | |
|---|---|---|---|
| DE | 296 16 971 U1 | | 11/1996 |
| EP | 0214951 | * | 7/1986 |
| WO | WO 93/18688 | | 9/1993 |

OTHER PUBLICATIONS

Supplementary European Search Report for EP 05 08 1240.

* cited by examiner

*Primary Examiner*—Milton Nelson. Jr.
(74) *Attorney, Agent, or Firm*—McDonnell Boehnen Hulbert & Berghoff LLP

(57) ABSTRACT

A multi-function, transportable, recreational folding chair, includes a plurality of storage compartments therein. In a preferred form, the chair is a lightweight chaise-lounge arranged in a backpack for ready transport of both the chair and paraphernalia stored therein.

17 Claims, 8 Drawing Sheets

MULTI-FUNCTION TRANSPORTABLE RECREATION CHAIR

This application claims the benefit of U.S. Provisional Patent Application No. 60/615,071, filed Oct. 1, 2004.

FIELD OF THE INVENTION

The present invention relates to chairs. More particularly this application relates to folding chairs and, in one example includes a multi-function, transportable, recreation folding chairs further including one or more storage container built therein.

BACKGROUND OF THE INVENTION

Portable chairs for beach, picnicking, backpacking, parades and other outdoor uses have long been known. One of the more common uses for such a chair is at the beach. For instance, beach chairs have been constructed of a plurality of lightweight metallic tubular members with a fabric or plastic webbing being stretched across the members in order to form a seat section and a back section. Generally, these chairs are changeable from a collapsed position, typically with the intent of occupying a minimum amount of space and facilitating portability, to an extended position which causes a leg assembly to be extended from the back section assuming a substantially right angled position to the seat section. In the past, these types of chairs have been merely carried to the setting of use by grasping some handy part of the chair. Other paraphernalia would also be carried separately, such as a table, cooler, and the like.

As an improvement to this conventional beach type of chair, there have been some attempts at designing collapsible type of chairs, which could be transported to the beach by being carried on one's back. In the alternate, such chairs have been designed to be folded into an elongate, but compact form, and fit into a carrying case. Also, it has been known in the past to construct a beach chair that includes pouches, intended to be utilized to store articles, such as suntan oil, comb, brush and so forth. However, there is room for improvement in designing such chairs so that the chairs are of high quality and more durable construction, and are more quickly movable to the collapsed or retracted position and conversely are quickly movable into the extended or usage position, and advantageously include necessary additional items usable by normal beach goers, and storage areas for the same.

Accordingly, there is a need for a recreational chair or the like that provides for ease of transport and use, while proving features directed to the carrying of additional items. The present invention addresses this need.

SUMMARY OF THE INVENTION

One multi-function, transportable recreation chair that satisfies most, if not all of the above-identified need is shown in U.S. Pat. No. 6,402,231, which is incorporated herein by reference.

One aspect of the present invention includes a multi-function, transportable recreation chair of the present invention, which is an improvement over the art, providing in one form of the invention a compact chaise-lounge chair that can be backpacked, carried or wheeled. When conveyed as a backpack, the chair may include straps reminiscent of a backpack. In the form of the invention shown hereinbelow, it furthermore yields storage and stowage for miscellaneous items when going out for many different types of recreational activities. For instance, when going to the beach or an outdoor event, a person may typically separately carry a chair, an umbrella, a cooler, drinks and/or food, a towel, reading materials, a headset, suntan lotion, etc. The chair of the present invention accomplishes the difficulty of carrying the above items in one device.

The inventive chair in its form as a lounge chair in one preferred form provides a person with an adjustable recliner chair that has a leg rest, two armrests that also act as thermal containers for hot or cold products or storage, a storage seat base that can accommodate a pad, a towel, books, magazines, laptop computers, etc. The chair of the present invention also has a storage compartment at the leg rest and headrest that may accommodate an umbrella, sandals, shoes, and so on. An aspect of an embodiment of a chair according to the present invention includes an armrest, which in an unfolded condition provides and increased functionality in addition to that of storage. In particular, the armrest unfolds in such a manner as to present a horizontal surface, cup holders or the like in addition to access to storage areas, which may be liquid proofed and/or insulated. The armrest may unfold and lock or be held in a position whereby an inside surface/panel is held in a horizontal position to provide an accommodation for items thereon or therein.

The chair of this invention is most preferred in an arrangement with all of the parts foldable into an area not much bigger in size than a large backpack. In this form, it is of a durable rigid construction, yet very lightweight and easy to transport, including within its various compartments much of the paraphernalia that one may wish to use, such as at the beach or any other outdoor activity. This preferred form of the invention advantageously uses various storage components.

A further aspect of one embodiment of the invention provides an elastic inset panel positioned in such a manner in the backrest portion of the chair as to accommodate various anatomical features of the user without compromising the integrity and support of the backrest, such as for example a woman's bosom when she is using the chair in a prone position on her stomach.

Yet another aspect of an embodiment of the invention provides a conveniently positioned handle, which is offset so as to provide a reduced chance of the user colliding with a part of the chair while pulling it behind.

That being said, the chair may be constructed of a molded lightweight plastic material, metal frame members or any suitable material or construction method. It preferably includes retracting/removable support portions (i.e., chair legs), a part to support the user's legs in a lounge chair form and a part to support the user's torso, both connected to a central seating part with armrests.

Furthermore, the seat portion of the chair advantageously includes a storage container, as does the back support. Additionally, the chair armrests are hingeably attached on the side of the chair. The armrests, like the seat portion, may also include storage space. The storage space may be constructed so as to insulate the objects therein (i.e., to keep foods or liquids warm or cold), as well as to keep the objects therein dry. Additionally, the storage container contained within the seat portion of the chair may be constructed to carry larger objects, such as, for example, an umbrella, a book, a laptop computer, magazines, etc.

The various parts of the chair itself are preferably designed to be folded together in an interlocking arrangement of generally boxlike components so as to easily transport the chair, such as, for example, as a backpack or an item of luggage. It is shown herein readily adapted as a handcart, with wheels added to virtually the same backpack form; all of which will be explained in detail below.

BRIEF DESCRIPTION OF THE DRAWINGS

The above-mentioned and other features and advantages of this invention, and the manner of attaining them, will become more apparent and the invention will be further understood by reference to the following description of an embodiment of the invention taken in conjunction with the accompanying drawings, wherein.

Figure 1:
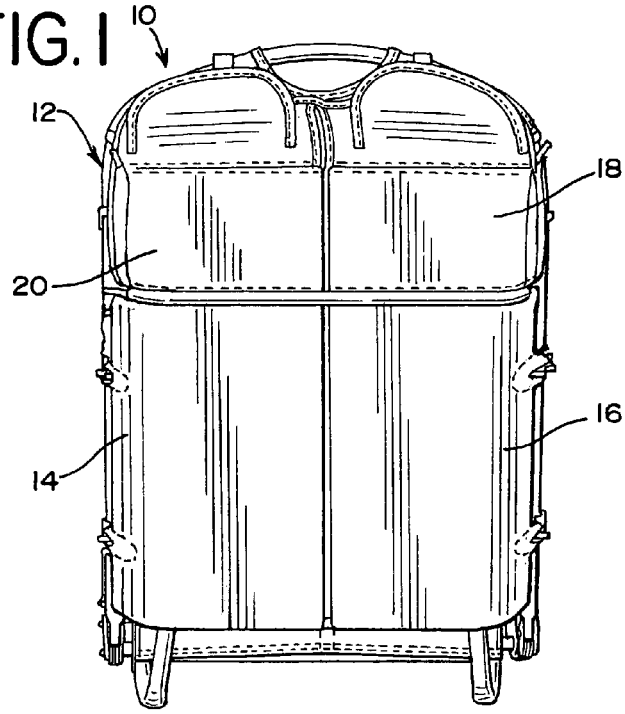
FIG. 1 shows a back view of an embodiment of a multi-function transportable recreation chair according to the present invention.

Corresponding reference characters indicate corresponding parts throughout the several views. What is illustrated is one preferred embodiment of the invention, in but one presently contemplated form, and such an illustrative example is not to be construed as limiting the scope of the invention in any manner, except as set forth in the claims.

DETAILED DESCRIPTION OF A PRESENTLY PREFERRED EMBODIMENT

In broad overview, the present invention relates to a recreation chair, which may be multi-functional and transportable. As described in the following embodiment, it has found one application as a beach chair. While it may be described in that particular environment, it will be understood that the invention has much broader application.

Referring now to the drawings, there is shown a multi-function, transportable recreation chair 10. In FIG. 1, chair 10 is illustrated in a retracted stowage (i.e., transport) position. As shown in FIG. 1, chair 10 includes of a frame 12 which when folded into a closed, compacted position causes the chair 10 to assume a generally rectangular boxlike construction or shape. In the embodiment shown, frame 12 is constructed of tubular members made of a lightweight metal, such as for example aluminum or steel. It will be understood that the frame may be made of any suitable material and construction, for example, by welding or use of fasteners and conventional hinges where various subsections of the frame are intended to be pivotable with respect to another. It should be noted that a number of hinges are depicted in the appended figures for connecting various frame parts of the invention, which will be familiar to one with ordinary skill in the art, and which may not all be specifically referred to in the following description. These hinges may be simple pivoting members or may include a feature for fixing the attached frame members in a desired position or configuration, such as a friction feature, ratchet feature or hole and pin lock for example.

The chair 10 includes a first armrest portion 14, second armrest portion 16 and back containers 18 and 20. When in the transport position, chair 10 may be compact and generally boxlike in shape. That is, chair 10 may take the form of any substantially rectangular device, including a box, a contoured device or any other similar geometric shape.

Figure 9:
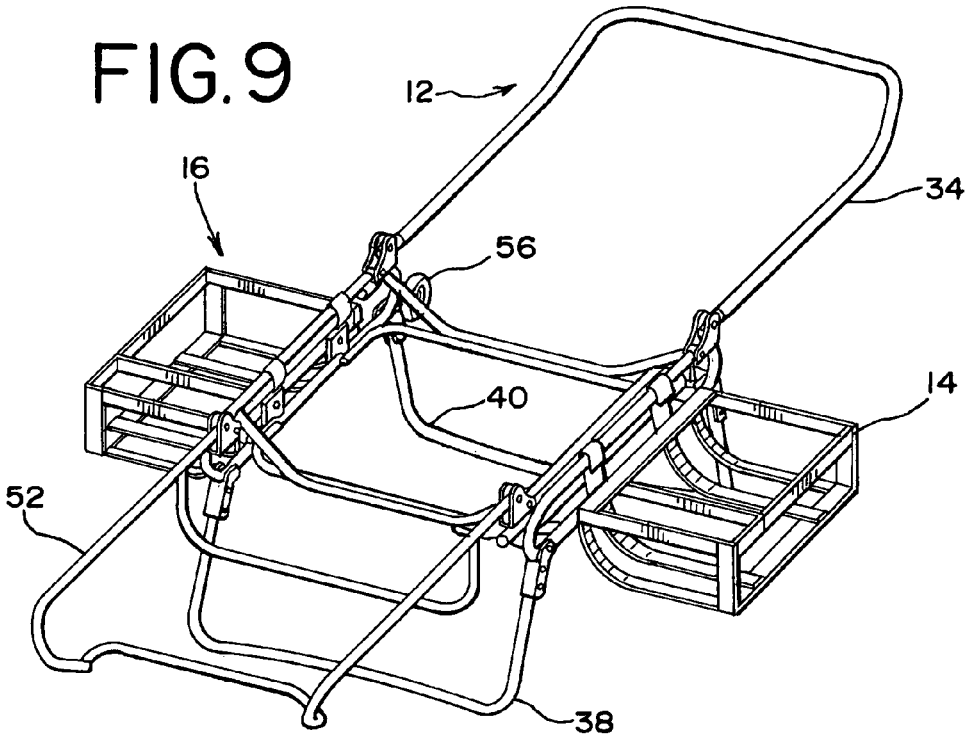
Figure 10:
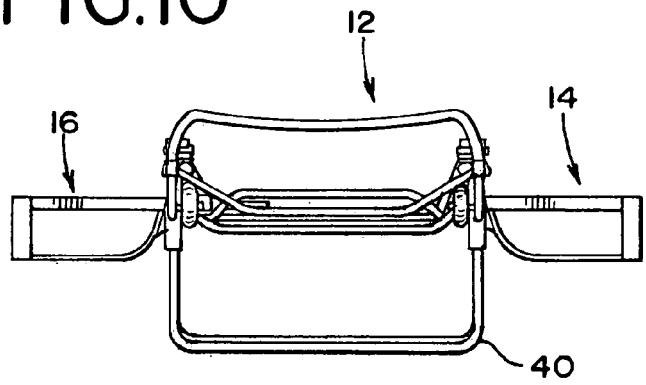

Many of the major components of the chair 10 are constructed of plastic and metal frame members, for example. Other similar lightweight material may be used, of course, and not all of the major components need be made of the same material. As will be shown in more detail below, the frame components may be made of tubular construction, metal or other suitable materials. Conventional webbing or other suitable coverings may be positioned on the frame components to form the various panels, components and surfaces of the chair. For example, first and second armrests 14, 16 (see FIG. 9) and first and second containers 18, 20 may be defined or formed of an internal framework in a known manner and covered with a synthetic nylon material or any other suitable material. The first and second containers 18, 20 may be made so as to be removably attachable to the chair 10. In one example, containers 18, 20 are provided with a hook-and-loop fastener connectable to a portion of the chair frame 12 or fabric positioned thereon. This feature permits one or both of the compartments to be removed and taken with the user. If a user is at the beach, for example, the user may decide to visit a concession stand or a restroom, for example, and can take his/her valuables or other items in the detached compartment while the remainder of the chair is left in place. This adds a level of convenience and security to the present chair 10, not typically or presently seen in the art.

All of the various compartments described herein of the back, seat and armrest portions are accessible when the chair is in an upright position shown in FIG. 1. Another feature of the chair of the present invention is that when the leg portion and armrests are removed, all of the fabric material may be removed for cleaning or replacement.

Figure 2:
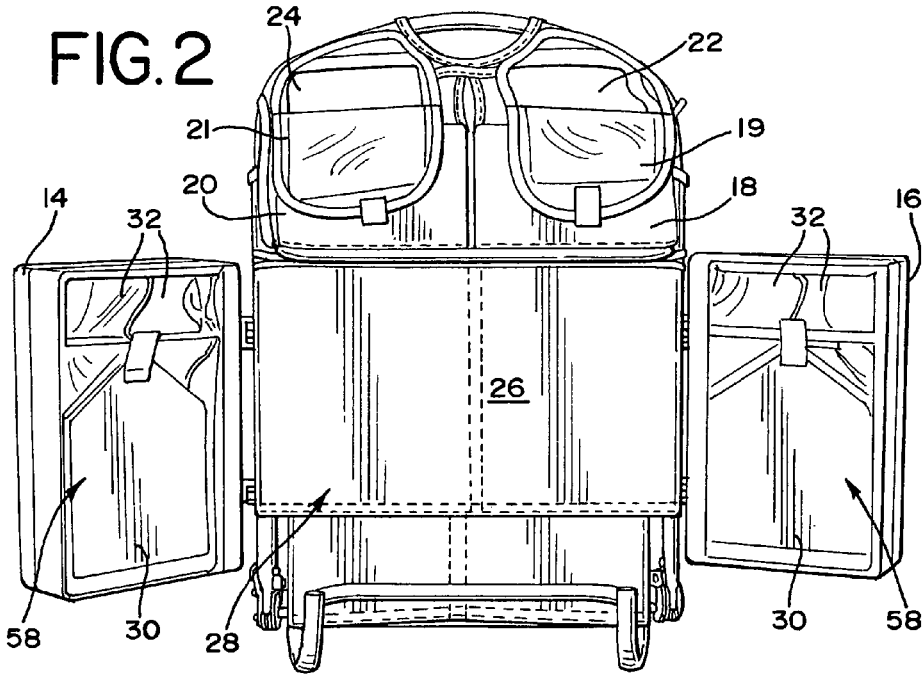
FIG. 2 shows a back view of the chair of FIG. 1 with the arms in a partially unfolded position.

Referring to FIG. 2, chair 10 is illustrated with armrests 14, 16 in a partially opened position. First and second containers 18, 20 are shown with respective closures 19, 21 in an open condition to permit access to internal compartments 22, 24. Each of the armrests 14, 16 are shown with an armrest compartment 30 and a pair of adjacent cup holder features 32 accessible from an inside surface 58. With the armrests 14, 16 in the position shown the rear side of the back panel 26 is exposed and the web material for supporting the user is upper body is shown at 28. The web material may be preferably a nylon fabric or any suitable fabric.

Figure 3:
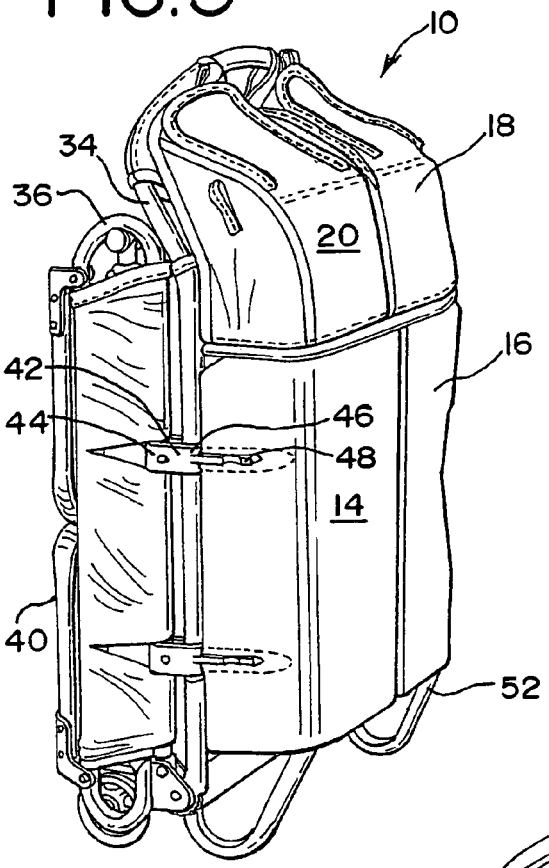
FIG. 3 shows a back perspective view of the chair of FIG. 1.

Referring to FIG. 3, chair 10 includes left and right armrests 14, 16 in the closed position wherein inside surfaces 58 are held against back panel 26 (see FIG. 2). Above the armrests 14, 16 are the compartments 18, 20. A portion of the frame making up the upper body subsection 34 of the frame is shown with the armrests 14, 16 and compartments 18, 20 adjacent thereto. A portion of the mid portion of the frame 12 is shown which supports a middle subsection or seating portion 36 of the frame, which when the chair is unfolded functions to support the mid body of the user when in use. A front leg 38 is attached to a mid portion 36 of the frame 12. A rear leg 40 is attached to a mid portion 36 of the frame 12 on an opposite end thereof from front leg 38.

A novel hinge 42 attaches each of the armrests 14, 16 to frame midsection 36. The hinge 42 includes a first or pivot end 44 formed into a loop or cylinder, which is the attached to the mid portion 36 of the frame 12 and permits each armrest to pivot around that frame member by acting essentially like a bushing or collar. A second or clasping end 46 of hinge 42 is curved or formed like a hook in such a fashion so as to receive and hold a frame member constituting the upper body subsection 34 of frame 12 when the arm rests 14, 16 are pivoted into a position against the back section or panel 26 of the chair 10 (see FIG. 2). In this fashion hinge 42 not only permits the armrests to pivot from a folded to an unfolded position and back but the hinge also functions with clasping portion 46 to hold chair 10 in a closed position securely during transport or storage, for example. A stabilizer extension or brace 48 of hinge 42 contacts with portion of frame subsection 36 so as to stabilize or brace the armrests in a fully opened and horizontal position. A portion of frame 12 is shown which constitutes the third subsection 52 of the frame, for supporting the legs of the user. The third subsection 52 also functions to keep the chair 10 and in an upright position when in the folded condition.

Figure 4:
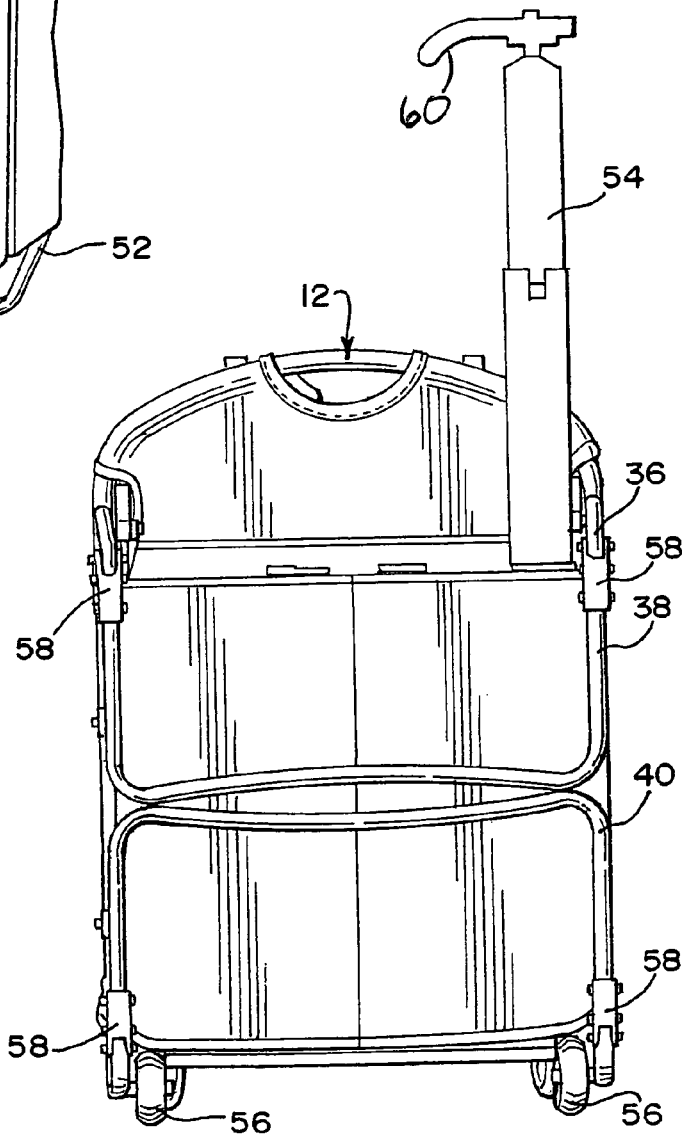
FIG. 4 shows a front view of the chair of FIG. 1.

Turning to FIG. 4 front leg 38 and back leg 40 are hingedly attached to frame mid subsection 36, and shown in a folded condition. Chair 10 may also include wheels 56 disposed near the bottom end of frame mid portion 36, for easily transporting the chair. It will be understood that the legs 38, 40, while shown as U-shaped members for providing support to the chair 10 may also be conventional pivoting or folding rod-shaped or cylindrical legs (not shown). As is known in the art, the legs 38, 40 may be secured in place by a pinned hinge or joint. Also, the legs may be telescoping in construction.

First leg 38 and second leg 40 are attached to seat portion 28 in a manner allowing for the repeated folding of the legs, such as, for example, through the use of hinges 42. The legs 38, 40 may be U-shaped in general shape and of tubular or cylindrical metal, and may pivot via shafts or pins provided on the foregoing hinges 42. A stop (not shown) may be provided to the pivoting movement in the extended position of the leg stand portions. This type of leg stand arrangement is well known.

A handle 54 may be provided and attached to the frame 12. In the illustrated embodiment shown, handle 54 is offset to one side of the chair 10. Offsetting the handle 54 is preferred due to the conform of holding chair 10 by wheels 56 off to one side, which permits the user to avoid striking the chair with his or her heels or otherwise come into contact with the chair during transport. The handgrip 60 may pivot to a position normal to the position shown for providing a comfortable grip to the user.

Figure 5:
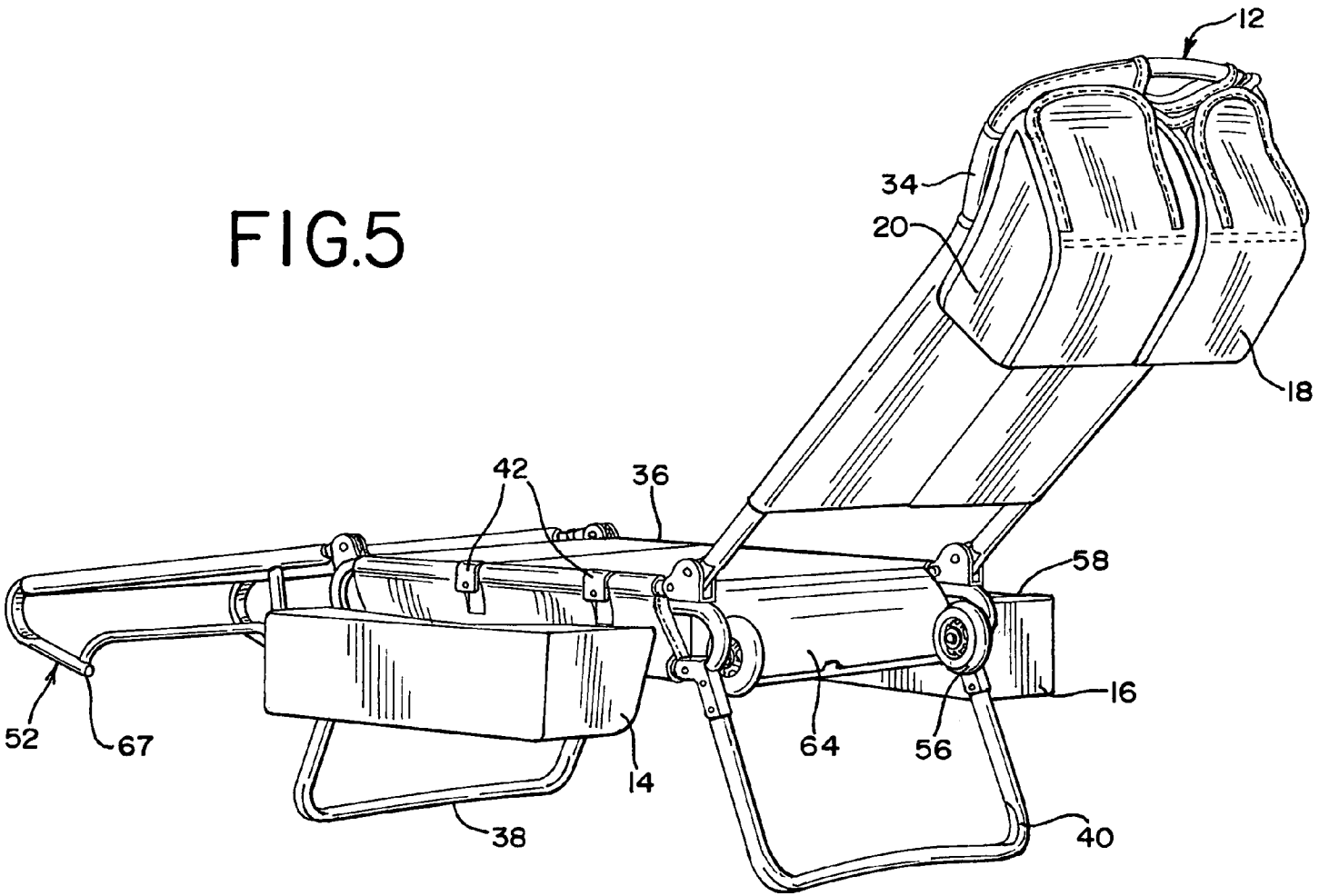
FIG. 5 shows a side perspective view of the chair of FIG. 1 in an expanded condition.
Figure 6:
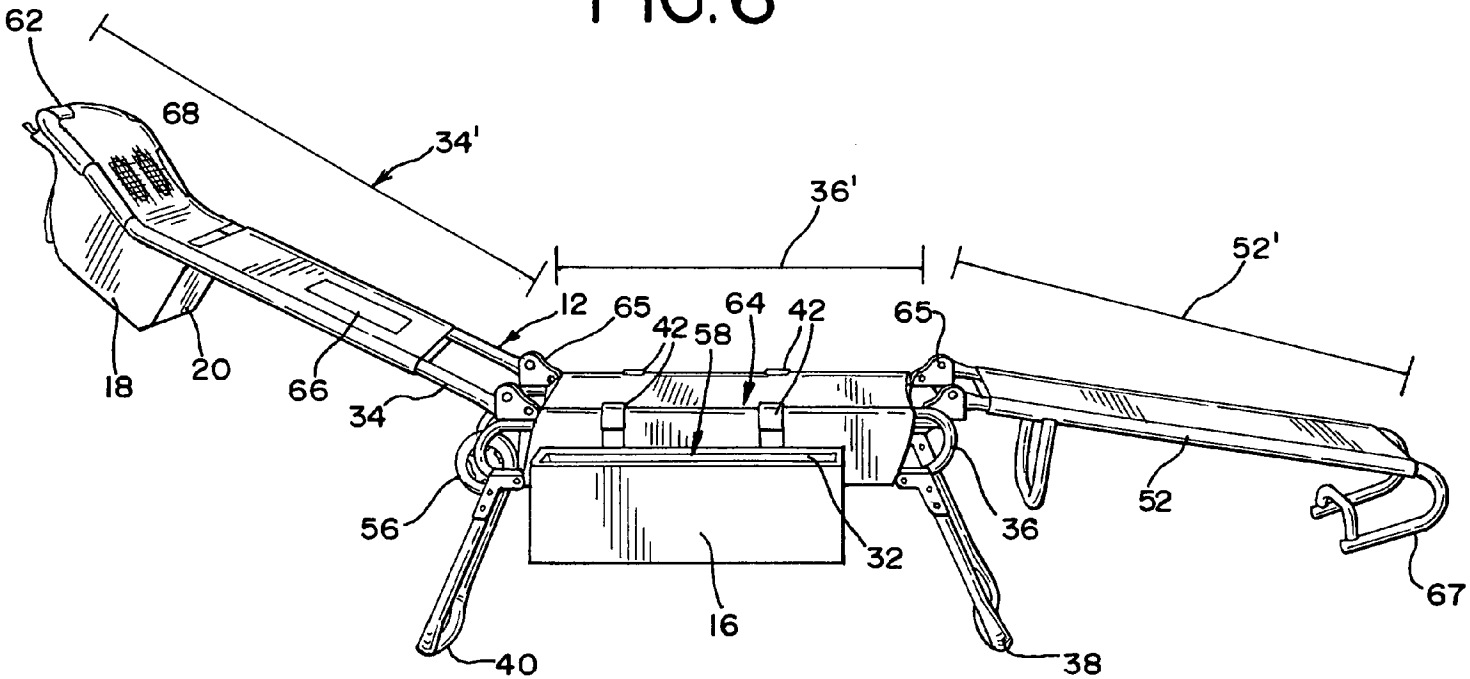
FIG. 6 shows a side view of the chair of FIG. 1.
Figure 7:
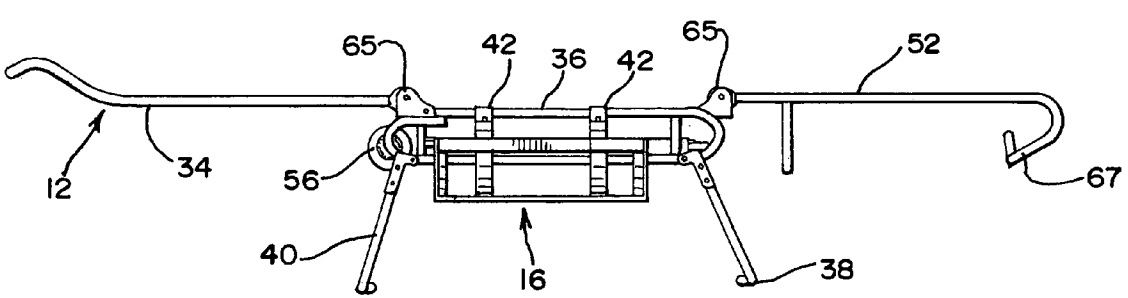
FIGS. 7-10 show various views of a frame for a foldable chair according to one embodiment of the invention.
Figure 8:
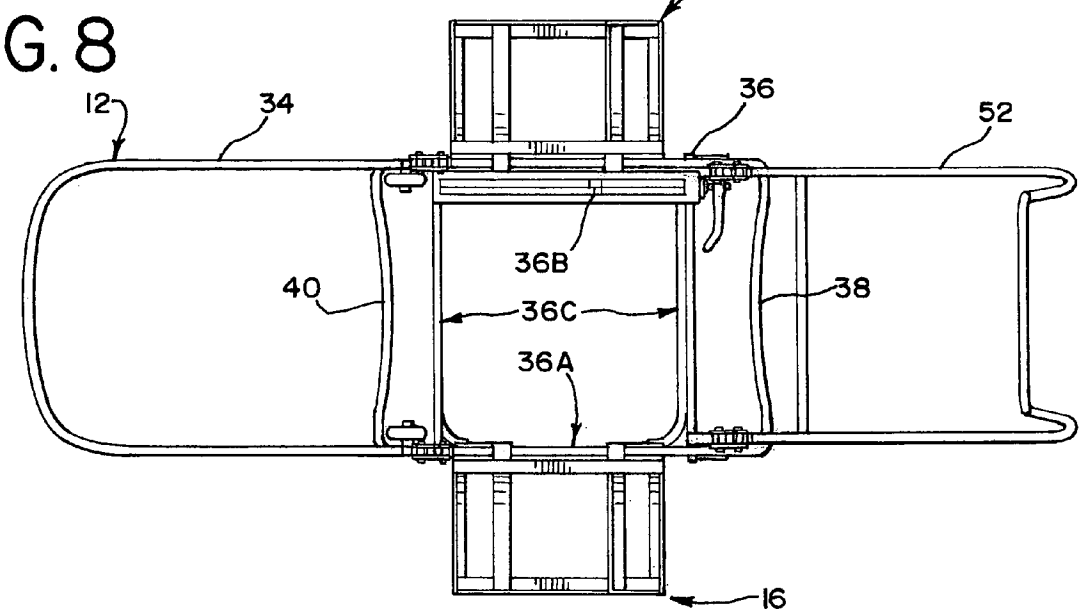

Turning to FIGS. 5 and 6 the three basic subsections of the chair frame 12 can be easily seen. The upper body subsection 34' of frame 12 includes an exposed portion 62 which can be used is a handle. First and second back containers or compartments 18, 20 are positioned near the top end of the upper body 34' subsection of the frame12. A pair of weather-resistant or weatherproof speakers and associated electronics for reproducing music and the like may be positioned in an upper section of upper body subsection 34' of the chair 10. The speakers 68 and associated electronics (such as a battery operated amplifier, receiver, MP3 player, CD player, etc., not shown) may be advantageously positioned in one of the compartments 18, 20 or the speakers may be provided without any electronics, and thereby provide a detachable connection to a sound producing device supplied by the user.

The upper body subsection 34' of chair 10 may also include an insert panel of relatively stretchable material 66 sufficient to accommodate various users. For example, a woman using the chair 10 may find the chair more comfortable and physically accommodating anatomically while in a face down position due to the stretchable panel insert. The panel may be made of any stretchable material, for example, spandex or Lycra®.

A conventional ratcheting mechanism 65 may used to hold the upper body subsection 34' of the frame to be mid section 36' of the frame 12 and functions to hold the upper body section of the frame at a selected angle during use. A similar mechanism 65 may hold leg portion 52' at a selected angle with respect to the mid section 36'.

The midsection 36' of the frame includes a front leg 38 and back leg 40 shown in a deployed condition or position and left and right armrests 14, 16 also shown in an open and horizontal position. The armrests 14, 16 are held with an inner surface 58 oriented horizontally by the hinges 42. As explained above the back compartments 18, 20 and armrests 14, 16 both contain space for storage. The mid portion 36' of frame also has an internal compartment 64 for storage. This internal storage area 64 may extend roughly the entire length and width of the seat portion 36 of the chair 10, providing a fairly large storage container.

Leg frame portion 52 has been unfolded from its closed position (as shown in FIG. 3) to form the leg portion 52' of the chair 10. Preferably, leg portion 52 is fixably attached to seat portion 36 in any manner allowing for repeated folding of leg portion 52, such as, for example, through the use of one or more hinges or ratchet mechanisms 65 as is known in the art. Leg portion support 67 is formed at the lower end of the leg frame portion 52, which rests upon the ground and gives some elevation to the leg portion at this end.

FIGS. 7-10 show the frame 12 of one embodiment of the present invention in an unfolded condition and without covering. Frame 12 includes upper portion 34, which has a general U shape. The upper portion 34 may be pivotally connected to the mid-portion 36 of the frame 12 by way of ratcheting hinges 65. The mid-section 36 of the frame 12 may be formed of a pair of parallel loops 36A, 36B joined by cross members 36C. The end of the mid-section 36 adjacent the upper section 34 includes a rear leg 40 attached thereto as well as a pair of spaced wheels 56.

The frame 12 includes right and left armrests 16, 14 attached by way of hinges 42. The framework for each of the armrests is shown in more detail in FIG. 11. Each armrest 16, 14 is attached to respective loops 36A, 36B.

The mid-section 36 of frame 12 includes a front leg 38 attached to an end thereof opposite the rear leg 40. A leg section 52 of the frame 12 is attached to the end of the mid-section 36 adjacent the front leg 38. The leg section 52 may be attached by way of hinge/ratchet mechanisms 65 which permit the pivoting of the leg section relative to the mid-section and locking it into a desired position. The leg section 52 is similar in shape to that of the upper section 34 with the addition of a curved leg support 67 formed at a terminal portion of the leg section.

Figure 11:
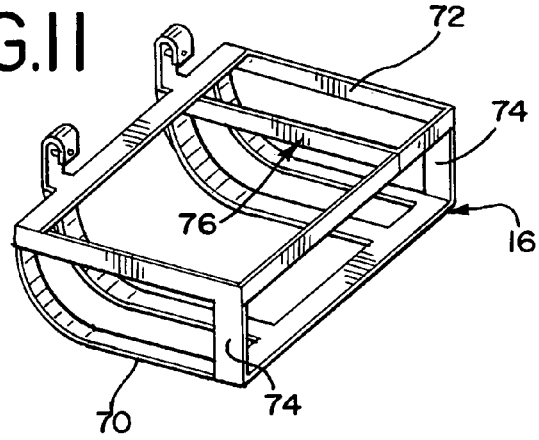
FIG. 11 shows a sub-frame for an armrest of the frame of FIG. 7.

FIG. 11 shows an embodiment of the right armrest 16. The right armrest 16 is a mirror image of the left armrest 14 (See FIG. 9). Right armrest 16 includes a framework including a plurality of bottom members 70 which curve upwardly on an inner edge thereof to meet a rectangular top frame 72. A pair of outer frame members 74 space the distal portions of the bottom and top frame members 70, 72. Upper frame 72 may include a cross member 76.

Figure 12:
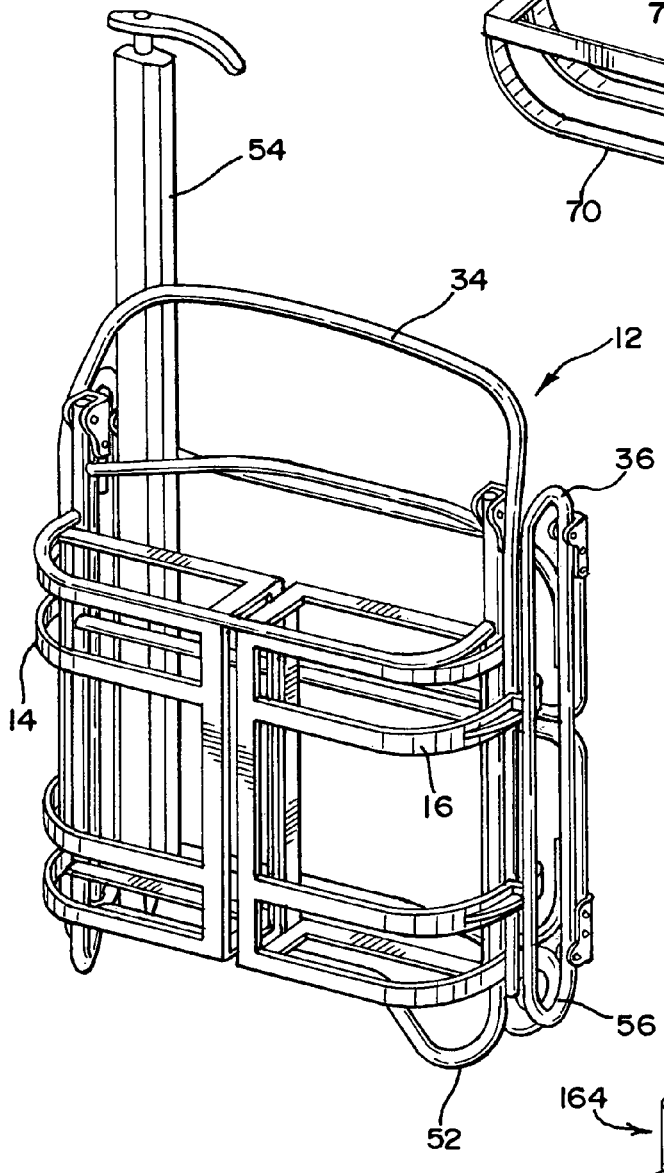
FIG. 12 shows the frame of FIGS. 7-10 in a folded condition.

FIG. 12 shows the frame 12 in a closed condition. The leg portion 52 is folded underneath and adjacent the upper portion 34 along the mid-portion 36 of the frame 12. In this configuration, when upright, the frame 12 rests on the distal end of the leg portion 52 and wheels 56. The right arm rest 16 and the left arm rest 14 are folded inwardly to the underneath of the leg portion 52. The handle 54 is attached to one side 36B of the frame mid-portion 36. In this configuration, also shown in a covered condition covered in FIG. 1, for example, the chair 10 of the present invention assumes a compact and easily conveyable unit.

Figure 13:
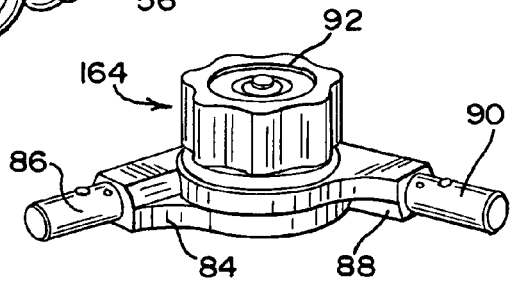
FIG. 13 shows a ratchet mechanism for securing a chair leg in a desired position.

FIG. 13 shows an example of a device for securing parts of the chair 10 in a desired configuration. The device is a fixable pivot 164 having a first pivot portion 84 with a first post 86 sized and shaped to fit into and secure to a first one of the frame sections 34, 36, 52 (see FIG. 6) and a second pivot portion 88 with a second post 90 sized and shaped to fit into and secure to an adjacent one of the frame sections. A spring (not shown) is disposed between the first pivot portion 84 and the second pivot portion 88 to bias the two pivot portions apart. A knob 92, when tightened, draws the first pivot portion 84 against the second pivot portion 88 and the resulting friction therebetween holds the pivot 164 in position. In the alternate, each of the first pivot portion and the second pivot portions 84, 88 may be provided with inner facing teeth (not shown), which mesh when the knob 92 is tightened to secure the pivot 164 in position.

Figure 14:
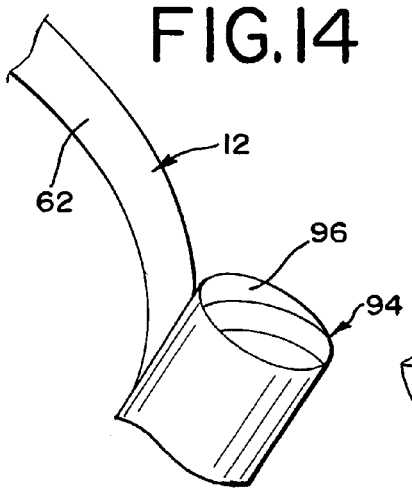
FIG. 14 shows a receptacle for receiving chair accessories according to the invention.

FIG. 14 shows frame 12, and in specific the exposed portion of the frame handle 62 wherein a receptacle 94 having internal threads 96 is provided. The receptacle 94 is sized and shaped to receive a variety of accessories, such as for example an umbrella (not shown) that can be inserted into the receptacle and secured by rotating to threadably engage the frame. It should be understood that the receptacle 94 may be one or more and located anywhere on the chair 10.

Figure 15:
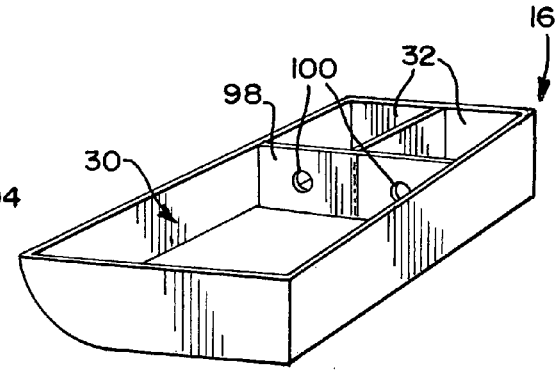
FIG. 15 shows a feature of the arm rest of the folding chair according to the invention.

FIG. 15 shows an embodiment of the second or right arm rest 16. It will be understood that the chair 10 of the present invention may be provide with one or two of the illustrated version of the arm rest. The arm rest 16 includes a bulkhead 98 between the arm rest compartment 30 and the cup holder compartments 32. The bulkhead 98 may include a pair of openings 100 formed therethrough. The openings 100 may be each sized and shaped to receive the neck of a beverage bottle for example, such as a wine bottle, and thereby secure the bottle in position.

Figure 16:
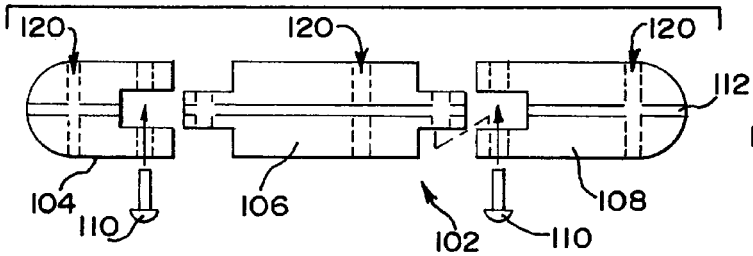
FIGS. 16 and 17 show a locking hinge.
Figure 17:
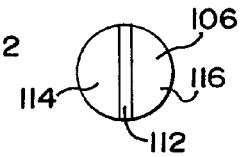
Figure 18:
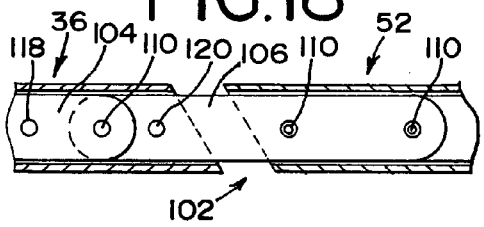
FIGS. 18, 19 and 20 show the hinge of FIGS. 16 and 17 in use with the legs of a chair according to the present invention.
Figure 19:
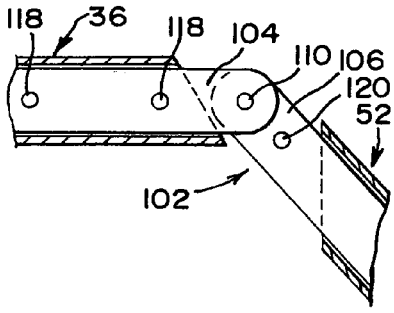
Figure 20:
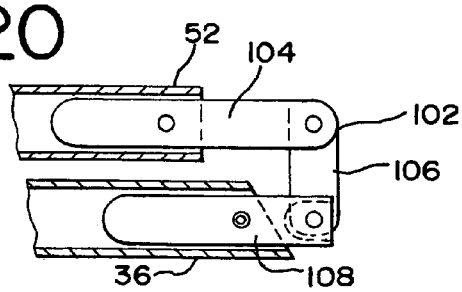

FIGS. 16-18 show an embodiment of a hinge 102 according to an embodiment of the invention. The hinge 102 includes a first hinge end section 104, a hinge mid-section 106 and a hinge second end section 108. Each hinge section 104, 106, 108 is pivotally connected to an adjacent section by a pin or rivet 110. As shown in FIG. 17, each section has a cross section, such as circular, to fit within a corresponding frame member as shown in FIGS. 18 and 19. One example of where the hinge 102 may be used is shown in FIGS. 18, 19 and 20 wherein the frame leg section 52 is pivotally connected to the frame mid-section 36.

Each section 104, 106, 108 preferably is constructed by laminating a metal center piece 112 to flanking plastic hinge bodies 114, 116. The metal piece 112 provides adequate strength to the hinge 102.

When fully inserted into frame member of sections 52, 36 or the like, the hinge mid-section 106 provides reinforcement thereto and maintains the frame sections in an aligned or straight condition (see FIG. 18). When the frame member sections 52, 36 are drawn apart, the hinge 102 may pivot and the orientation of the frame member sections are permitted to assume an angled configuration (see FIG. 19). In alternate embodiments, the frame member sections 52, 36 are provided with frame openings 118 which may be aligned with corresponding hinge openings 120 when the frame members are in a drawn apart condition or together. One or more pin (not shown) may be inserted through frame openings 118 and hinge openings 120 in order to maintain the position of the hinge 102 in the frame. FIG. 20 illustrates a unique feature of the hinge 102, whereas the leg may be folded closely to the adjacent section.

It should be appreciated that the embodiments described above are to be considered in all respects only illustrative and not restrictive. The scope of the invention is indicated by the following claims rather than by the foregoing description. All changes that come within the meaning and range of equivalents are to be embraced within their scope.

What is claimed is:

1. A portable, foldable chair, comprising;

a frame including a mid frame portion, two or more legs attached to said mid frame portion and an upper frame portion movably attached to said mid frame portion;

a covering on said mid frame portion and said upper frame portion, said covering forming at least a seat and a storage compartment defined within said mid frame portion, said storage compartment being sized and shaped to contain loose items and said covering defines said storage compartment in said mid frame portion as a fully enclosed space when said chair is in either of an open position or a folded position; and a first armrest and a second armrest movably attached to said mid frame portion, wherein each of said armrests includes an inside surface which faces said seat when said chair is in a folded position and is horizontal and is oriented upwardly on each of said armrests when in said open position.

2. The chair of claim 1, wherein said frame includes a leg frame portion movably attached to said mid frame portion at a point opposite said upper frame portion.

3. The chair of claim 2, wherein said first and second armrests include a storage compartment defined therein.

4. The chair of claim 2, wherein said armrest storage compartment includes a separate cup holder compartment.

5. The chair of claim 1, wherein said armrest storage compartment includes a bulk head defining at least one armrest compartment and one or more cup holder compartment.

6. The chair of claim 5, wherein said bulk head includes one or more opening.

7. The chair of claim 6, wherein said cup holder compartment is sized and shaped to accommodate a container and hold said container in position within said storage compartment.

8. The chair of claim 2, wherein said frame portions are movably attached by hinges.

9. The chair of claim 8, wherein said hinges are fixable in straight and angled configurations.

10. The chair of claim 1, wherein said first armrest and said second armrest includes a covering, said covering defining said inside surface.

11. The chair of claim 1, wherein one or more back container is provided on a back side of said upper frame portion.

12. The chair of claim 11, wherein one or more speaker is disposed on said upper frame portion and within said one or more back container.

13. The chair of claim 12, wherein an electronic device is disposed on said upper frame portion and within said one or more back container and operatively connected to said one or more speaker.

14. The chair of claim 1, further comprising an extendable and rotatable handle secured within said mid frame portion at one side thereof.

15. The chair of claim 1, wherein said upper frame portion includes a receptacle for attaching accessories to said frame.

16. A portable chair, comprising;

a seat portion including a fully enclosable seat storage compartment;

a back portion movably attached to said seat portion including a fully enclosable back storage compartment;

a leg portion movably attached to said seat portion, wherein said portions interlock in a transport mode to form a compact pack and wherein each of said seat and back portions is hollow; and a first armrest and a second armrest movably attached to said seat portion, wherein each of said armrests define a storage compartment therein and includes a panel which defines an inside surface which faces said seat portion when said chair is in a folded position and wherein the plane of said inside surface of each of said armrests is horizontal and is oriented upwardly on each of said armrests when said chair is in an open position.

17. The chair of claim 16, wherein said seat portion and said back portion include storage compartments, and said compartments of said seat portion and said back portion are accessible when said chair is in a folded and upright position and said compartments of said armrests are accessible when said armrests are pivoted out from said folded and upright position.

* * * * *